United States Patent [19]

Beltron

[11] Patent Number: 4,756,110

[45] Date of Patent: Jul. 12, 1988

[54] SPEED LOADER

[76] Inventor: James M. Beltron, P.O. Box 40384, Reno, Nev. 89504

[21] Appl. No.: 78,894

[22] Filed: Jul. 29, 1987

[51] Int. Cl.[4] ..... F42B 39/06

[52] U.S. Cl. ..... 42/87

[58] Field of Search ..... 42/87, 88

[56] References Cited

U.S. PATENT DOCUMENTS

| | | | |
|---|---|---|---|
| 211,691 | 1/1879 | Bennett | 42/87 |
| 391,811 | 10/1888 | Mixter | 42/87 |
| 719,808 | 2/1903 | Johnson | 42/87 |
| 869,484 | 10/1907 | Drake | 42/87 |
| 1,023,489 | 4/1912 | Altick | 42/87 |
| 1,025,525 | 5/1912 | Hoagland | 42/87 |
| 1,073,348 | 9/1913 | Hoagland | 42/87 |
| 1,082,867 | 12/1913 | Hoagland | 42/87 |
| 1,874,408 | 8/1932 | Zichy | 42/87 |
| 2,403,012 | 7/1946 | McPheters | 42/87 |
| 3,373,520 | 3/1968 | Into | 42/87 |
| 3,399,481 | 9/1968 | Giorgini | 42/87 |
| 3,986,286 | 10/1976 | Stangel | 42/87 |
| 4,509,284 | 4/1985 | Naber | 42/87 |

*Primary Examiner*—Charles T. Jordan

*Attorney, Agent, or Firm*—G. Donald Weber, Jr.

[57] ABSTRACT

A shotgun speed loader for storing shotgun shells or cartridges and depositing same into a magazine in a shotgun. Improved efficiency and speed of loading shotgun shells is achieved by the loader which comprises a flexible tube wall with an elongated slot therein and which snugly holds the shells but which permits rapid discharge thereof upon movement of a plunger traveling within the slot.

11 Claims, 1 Drawing Sheet

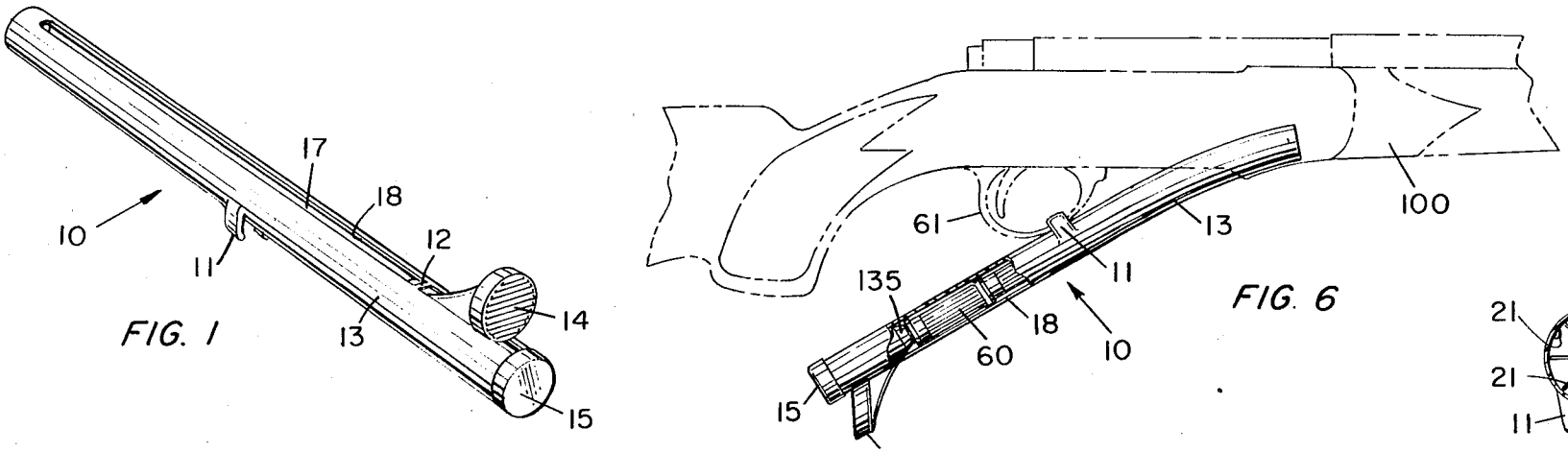
FIG. 1
FIG. 6
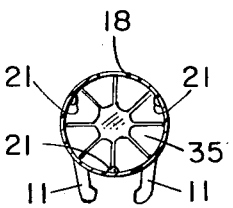
FIG. 5
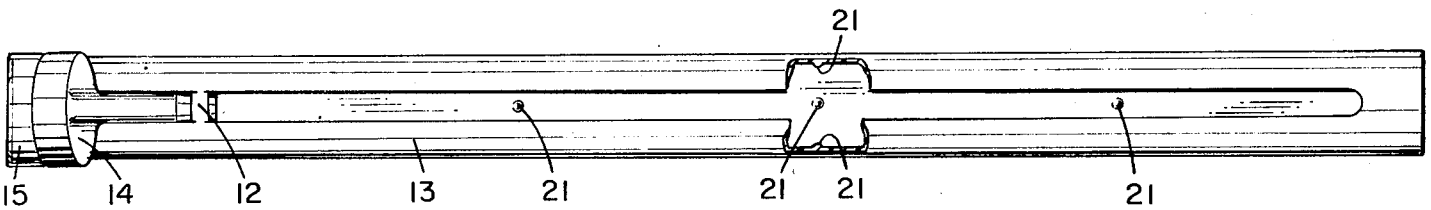
FIG. 2
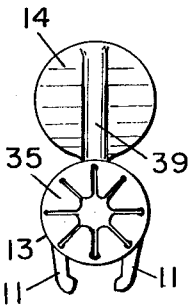
FIG. 4
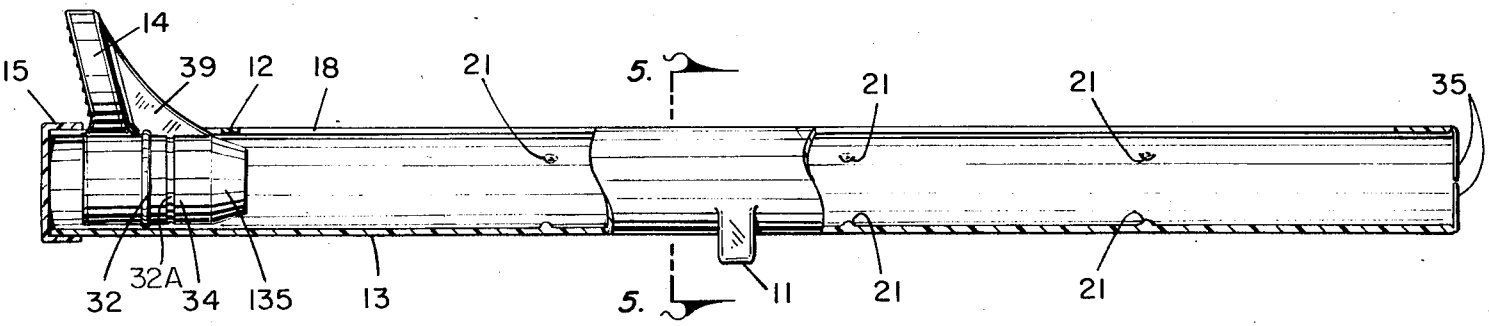
FIG. 3

SPEED LOADER

BACKGROUND

1. Field of the Invention

This invention is directed to weapons systems, in general, and to a speed loading device for use with shotguns, in particular.

2. Prior Art

A number of devices have been developed in the prior art for holding cartridges and supplying same into weapons such as revolvers, shotguns and rifles.

Referring to revolvers, there are devices which hold six (more or less) cartridges and individually deposit the cartridges into the rotatable chambered block of the revolver. Other devices include six cylinders, disposed in hexagonal, parallel relationship, and which load cartridges in groups of six. Other devices, known as clips can supply a designated number of cartridges via the grip portion of the handgun.

Referring to rifles, an elongated tube with plunger has been devised for holding several cartridges and shoving them into the magazine of the rifle. There are also clip devices for rifles. Moreover, there are numerous automatic weapons available. However, the foregoing devices are not designed for use with shotguns. In many instances such as hunting or the like, rapid fire capability is desired. In some situations such as police work, rapid fire capability is almost a necessity for defense of the police officer when under attack. Therefore, a simple, yet reliable speed loading device for shotgun shells is desirable.

PRIOR ART STATEMENT

A search of the prior art has uncovered the following patents which are listed in inverse numerical order:

U.S. Pat. No. 4,509,284; SHOTGUN SPEED LOADER; Naber. This patent is directed to a shotgun speed loader which includes a device for storing shells and depositing same into a magazine in a shotgun. The device includes a flexible tube with a slot therein which snugly holds shotgun shells until discharged therefrom by means of a plunger which moves within the tube.

U.S. Pat. No. 3,986,286; SHELL MAGAZINE AND FEEDER; Stangel. This patent is directed to a shell dispenser and container for trap and skeet shooters. The dispenser includes a plurality of tubular elements partially apertured to permit the removal of a pair of shells under a similar aperture in the top of the container. This device permits the placement and storage of a load of shells through the same container aperture.

U.S. Pat. No. 3,399,481; DETACHABLE CHARGER FOR AUTOMATIC SHOTGUNS; Giorgini. This patent is directed to a detachable charger for automatic shotguns. The detachable charger is inserted into a fixed charger tube disposed rigidly along the barrel of the gun in front of the cartridge feeding mechanism in order to permit easy and rapid placement of the charger and other types of ammunition.

U.S. Pat. No. 3,373,520; AMMUNITION PACKAGE AND MAGAZINE; Into. This patent is directed to an ammunition package formed of semi-rigid plastic material which can be inserted directly into a firearm to function as a magazine tube or it can be inserted into a tubular magazine to form a liner and part of the magazine. The device stores a plurality of cartridges which are positioned in the tubular body and has means for closing and sealing the end of the tubular body.

U.S. Pat. No. 1,874,408; SHOTGUN LOADER; Zichy. This patent is directed to a shotgun loader which may be attached to the wrist of a shooter leaving the hand free so as not to interfere with handling of the gun. The loader includes two containers. Within each of the containers a loaded shell is supported in relation to a spring mechanism capable of forcing the shell longitudinally of the container and within the breech of the shotgun. A suitable latch mechanism is provided to restrain the shells in the loader mechanism.

U.S. Pat. No. 1,082,867; DEVICE FOR OPENING TUBULAR CARRIERS; Hoagland. This patent is directed to a device which is used with the tubular carrier for holding a plurality of weapon type cartridges as defined in U.S. Pat. No. 1,073,348 noted below. In particular, this invention is directed to an opener device for opening the crimped end of the tube shown in the '348 patent.

U.S. Pat. No. 1,073,348; TUBULAR CARRIER; Hoagland. This patent is directed to a tubular cartridge carrier wherein a portion of the tube is bent inwardly to form an inclined stop wall within the tube. This stop wall prevents cartridges from inadvertently falling out of the tube.

U.S. Pat. No. 1,023,489; CARTRIDGE POCKET FOR HUNTING COATS AND JACKETS AND ETC.; Altick. This patent is directed to an improvement in a cartridge pocket for a hunting coat or jacket. The pocket holds cartridges or shells securely and yet the shells may be easily removed from the pocket. The pocket maintains the shells entirely enclosed wherein they are protected from inclement weather. The pocket includes metal casings at the lower end of the pocket which has suitable stops to arrest and support cartridges in the wholly encased condition and means for conveniently releasing each bottom cartridge.

U.S. Pat. No. 869,484; CARTRIDGE CARRIER; Drake. This patent is directed to a simple, compact and inexpensive carrier for cartridges wherein the cartridges lie longitudinally in the carrier and the carrier is adapted to transfer its contents, by a single movement, to the magazine of a rifle in position for feeding to the firing chamber.

U.S. Pat. No. 391,811; CHARGER FOR MAGAZINE FIREARMS; Mixter. This patent is directed to an implement which carries a series of cartridges which can be easily introduced into the magazine of a weapon and includes a spring mechanism to force the cartridges though the tubular implement.

SUMMARY OF THE INSTANT INVENTION

This invention provides a shotgun speed loader comprising an elongated tube assembly for holding a plurality of shotgun shells. An elongated slot is formed in the wall of the tube assembly, along at least a major portion of the length of the tube assembly. A pusher device is disposed within the tube assembly. A portion of the pusher device projects through the slot as a pusher handle for access by the user. When the pusher handle is moved in the slot along the length of the tube assembly, the pusher device travels within the tube assembly thereby causing the shells to be pushed rapidly from the tube assembly into the magazine of the shotgun.

BRIEF DESCRIPTION OF THE DRAWINGS

FIG. 1 is a perspective view of the speed loader of the instant invention.

FIG. 2 is a top view of the speed loader of the instant invention.

FIG. 3 is a partially broken away side view of the speed loader of the instant invention.

FIG. 4 is an end view of the speed loader of the instant invention.

FIG. 5 is a sectional view of the speed loader of the instant invention taken along the lines 5—5 in FIG. 3.

FIG. 6 is a schematic view of the speed loader in position to load shells into a shotgun.

DESCRIPTION OF THE PREFERRED EMBODIMENTS

Referring now to FIG. 1, there is shown a schematic representation of the shotgun speed loader 10 of the instant invention. The loader 10 includes, generally, a tube assembly 13 and pusher device including a pusher handle 14 and a body member 34 (see FIG. 3).

The tube assembly 13 includes an elongated, flexible tube wall which is, generally, circular and annular in cross-section, forming an interior storage space 17 for the shells. An elongated slot 18 is provided through the wall of tube assembly 13 and extends approximately from end-to-end thereof. The slot 18 is substantially parallel to the longitudinal axis of the tube assembly. As shown, the slot 18 has a substantially uniform width but is not limited thereto. That is, the slot may be somewhat narrower than shown whereupon it becomes slightly deformed by the pusher handle 14 as it passes therealong. This latter arrangement may tend to restrain the pusher handle 14 in the speed loader. In an alternative embodiment, the slot 18 can be the entire length of the tube assembly 13 with caps 15 or the like at the ends thereof. At the rear end of tube assembly 13, the cap 15 retains the shells within the tube assembly 13. A suitable means is provided at the front end of the tube assembly in order to retain the shells inside the tube assembly in normal usage.

A trigger guard latch 11 is advantageously provided at the side of the tube assembly 13 opposite to slot 18. The latch 11 is located between the ends of the tube assembly. The precise location is, effectively, determined by the type of shotgun which is to be used. Thus, the latch 11 can be used to grasp the trigger guard of the shotgun to aid in stabilizing the speed loader relative to the shotgun.

The pusher device includes a body member 34 having the same generally cylindrical shape as the shell 60. A pusher handle 14 is connected to the upper, rearward portion of body member 34. The pusher handle 14 includes a relatively flat, circular configuration which is easily engaged by the user's thumb or palm. A suitable strengthening web structure 39 supports the pusher handle 14 relative to the body member 34. Of course, other suitable configurations of pusher devices can be utilized.

A thin strap or band 12 can be formed across the slot 18 in some embodiments. The band 12 can be fabricated of a thin relatively brittle, soft or otherwise removable material. Thus, when the pusher device is moved forward with a modest force the pusher handle 14, the band 12 is easily broken and does not interfere with the operation of the speed loader. In the absence of this force, the band 12 tends to maintain the pusher device in the position shown.

The band 12 can be included in the tube assembly 13, per se, or it can take the form of an "add-on" band, or the like.

Referring now to FIG. 2, there is shown the top view of the speed loader of the instant invention. In one embodiment of the invention, a plurality of detents or bumps 21 which extend radially inwardly from the interior of the tube are shown. As shown in FIG. 2 certain of the bumps 21 are visible through the slot 18. In the broken away portion of the Figure, additional bumps 21 are shown disposed around the inner peripheral surface of the tube. The number of such bumps is not intended to be limitative of the invention.

The bumps 21 (or indentations) are arranged to provide a relatively snug fit to the cartridges in the tube. The snug fit is arranged to prevent the cartridges 60 (see FIG. 6) from falling or sliding uncontrolled through the tube assembly whereupon the cartridges might tend to fall out of the front end of tube assembly 13. However, the fit must remain sufficiently loose that the shells or cartridges do not have a tendency to bind while being moved through the tube assembly inasmuch as the effectiveness of the tube assembly would be completely lost.

The dimension of the detent 21 (whether indentation or bump) must also take into consideration the tolerances which are permitted with the shotgun cartridge casings. However, by forming the detents 21 within the actual tube assembly, the detents may reflect and demonstrate the flexibility of the material of the tube assembly whereupon a certain amount of "give" or flex is inherent when the cartridges are moved through the tube assembly with a certain amount of force therebehind. While individual detents are shown, a plurality thereof or an annulus can be arranged in a suitable configuration around the inside of the tube assembly 13.

Referring now to FIG. 3, there is shown a partially cut away view of the speed loader. In this case, the body member 34 of the pusher device includes at least one detent 32. In one embodiment, the detent 32 may be in the form of one or more annular rings, a plurality of bumps, or the like. Moreover, the detents 32 can take the form of "bumps" which extend outwardly from the body member 34 of the pushing device. Alternatively, the detents can take the form of grooves or dimples 32A (shown in dashed outline) which engage the detents 21.

When the interior surface of the tube assembly 13 includes a plurality of detents 21 or the like, formed at the inner surface of the tube assembly, the bump (or groove) detent 32 (or 32A) interacts therewith. The relationship between the bumps 32 and the detents 21 is to permit the selective engagement thereof. This engagement can be made to be as stiff or as loose as desired.

The advantage of forming the detents 21 as recesses or grooves in the tube assembly rather than bumps (as shown in FIGS. 2 and 3) is that the shells will not tend to "hang-up" in the tube assembly 13. The pusher device can readily move forwardly or backwardly under force exerted by the user on pusher handle 14. However, the shells will not bind in the tube. If the pusher device does, in fact, have any tendency to bind, it can be readily overcome by applying additional force thereto.

The detent arrangement also has the additional advantage that it will tend to prevent the shells and/or pusher device from independently moving backwardly within the tube. In other words, some minimal force is required to move the shells 60 and the pusher device comprising pusher handle 14 and body member 34.

Referring now to FIG. 4, there is shown the front end view of the loader assembly of the instant invention. It is seen that the pusher handle 14 is mounted above the tube assembly 13. The support web 39 is formed thereto. Also, a plurality of flexible fingers 35 are shown extending inwardly from the outer surface of tube assembly 13 toward the center thereof. The fingers 35 may be formed of a portion of the tube assembly 13 or as part of a separate end cap for attachment to the tube assembly 13. The fingers 35 may be flexible so that the cartridges can be pushed therethrough by applying pressure to pusher handle 14. However, the fingers 35 should exhibit sufficient rigidity to retain the cartridges within the tube assembly 13 in the absence of force on the pusher handle 14.

In an alternative embodiment, the fingers 35 may be sufficiently brittle as to break-away under pressure. However, it is necessary that the "break-away" fingers be removed prior to loading the shotgun or in such other way in order that the debris not cause jamming or otherwise interfere with the operation of the gun.

Also, the break-away fingers 35 would be used in the case of a disposable speed loader device. Otherwise, a re-load of cartridges could not be retained in the tube assembly 13. The use of flexible fingers would, of course, provide a system comprising a re-usable device.

Referring now to FIG. 5, there is shown a cross-sectional view of the loader 10, taken along lines 5—5 of FIG. 3. In this view the interior of the tube assembly 13 along with fingers 35 is shown. In addition, the bumps 21 are shown extending into the interior space within tube assembly 13. The bumps 21 are arranged to interact with the annular ring 32 (or groove 32A) in the body member 34 of the pusher device. The interraction can be used to retain the speed loader parts in a particular position. In addition, the interaction may cause an audible and/or tactile sensation for the user. These sensations will provide the user with information as to the status of the speed loader. Clearly, upon frequent usage, the user will develop a "feel" for when the speed loader is operating, or empty, or the like. The trigger guard latch 11 is also depicted extending from the surface of the tube assembly 13.

Use of the loader 10 is shown in FIG. 6. The example of a loader 10 for a four-shot, 12 gauge shotgun 100 is shown. The pusher device is disposed at the rear of the tube assembly 13 and four shells 60 are stored in the tube. In this position, pusher handle 14 projects through slot 18. The cartridge case of the first shell 12 bears against the front end 135 of the pusher device body member 34. The remaining shells are disposed in end-to-end fashion with the cases toward the pusher device and enclosed within the tube assembly 13.

The loader 10 can be grasped by the pusher handle 14 or at any other location so that it can be easily carried or the like. During such time the shells 60 and pusher handle 14 do not move because of the relatively snug fit and, as well, the interaction of the bumps 21 against the casing flange of the cartridges, the body of the cartridge, or the detents 32 or 32A in the pusher device body member 34.

To load a shotgun, the loader 10 is disposed such that the front end thereof is adjacent to the entrance to the magazine of the shotgun. The spring loaded plate or the like which normally covers the entrance, is readily moved aside to open the entrance. Grasping the tube assembly 13, the user moves the pusher handle 14 toward the front end of the tube assembly 13. The pusher handle 14 moves through the slot 18. In the instance where the slot 18 width is less than width of the web support 39, the slot 18 is forced apart. The flexible tube assembly 13 expands such that the shell storage space 17 is enlarged in the radial direction. The pusher device body member 34 has the end 135 forced against the shells which move within the space 17. The shells slide up tube assembly 13, out the front end of the loader 10, and into the shotgun magazine. The loading of the shotgun, therefore, is effected by one swift hand motion of the operator.

In order to enhance the speed loader, the latch attachment 11 can be used. That is, the latch includes a pair of arms which depend from the tube assembly 13 or the side opposed to the slot 18. (Of course, a quadrature arrangement is also contemplated.) The arms 11 grasp the trigger guard 61 of the shotgun. This has the salutory effect of steadying the speed loader relative to the shotgun, per se. In addition, the pusher handle 14 is positioned away from the gun which permits free movement of the pusher handle 14.

In some cases of rapid-fire situations, latch 11 will not be used. However, in other situations, the speed loader 10 can be mounted on the gun by means of the latch 11 whereupon a re-supply of the weapon is readily available.

In some cases, the pusher handle 14 may cause the slot 18 and, thus, the tube assembly 13 to expand. This permits the shells and the pusher to more readily move over and past the the detent bumps 21.

To initially place the shells 60 into the loader 10, the pusher device can be removed along with cap 15. Conversely, the slot 18 can be widened by flexing and thereby expanding the tube assembly 13. Thus, shells can be dropped into the loader 10 at one end thereof or through the slot 18. When the last shell 60 is inserted, the pusher device and cap 15 can be easily replaced. Conversely, the tube assembly 13 is returned to its original shape whereby the tube assembly 13 snugly retains the shells.

The tube assembly 13 preferably is formed from a flexible plastic by shaping and cutting methods well known to those skilled in the arts of plastic handling and preparation. A tube assembly 13 formed from polyethelene or nylon has been found to be satisfactory. The pusher device including pusher handle 14 and body member 34 also may be formed from plastic although a light metal may be employed for additional strength.

The loader 10 has a number of advantages. For example, even with a full complement of shells, it is lightweight and easily carried. Furthermore, the loader 10 is relatively simple and does not have a multiplicity of parts. This permits the loader to be formed and cleaned easily.

The loader 10 can take many orientations with respect to the shotgun during the loading thereof whereupon, it can be employed with optimum results with a great variety of shotguns.

Clearly, the loader 10 will operate to load the shotgun with one or more cartridges upon a single, rapid arm movement of the operator. Thus, the loading is very quick and the gun can be fired at a high rate.

The applicability of this shotgun speed loader is believed to be apparent from the foregoing description. Although a preferred embodiment has been disclosed herein, it is to be remembered that various alternate constructions can be made thereto without departing from the scope of this invention.

Thus, this invention provides an improved structure for storing and rapidly loading shells into a gun, especially a shotgun. The structure is readily carried, is not cumbersome or inconvenient to use, and which facilitates maintenance of a rapid rate of shotgun fire. Moreover, the invention comprises a rapid loader which can be employed with most automatic or pump shotguns without special adapters or alterations to the weapons. The rapid loader of the invention is relatively simple in construction, easily fabricated and maintained, and durable.

It should be noted that the description herein is intended to be illustrative only and is not intended to be limitative. Rather, the scope of the invention is limited only by the scope of the claims appended hereto.

I claim:

1. A shotgun speed loader comprising:

flexible wall means defining a column space for receiving at least one shell, and defining a storage position connected with said column space;

slot means is formed in said flexible wall means; and pusher means mounted in said flexible wall means and movable from one end of said flexible wall means through said slot means thereby effecting rapid discharge of the shell from said column space;

said pusher means includes a body and a handle joined thereto;

said body includes at least one detent means arranged in annular form at the surface thereof to engage with one or more detent means formed at the inner surface of said flexible wall means;

said handle movable in said slot means, and said body movable in said column space, when said pusher means is moved from said storage position.

2. The loader of claim 1 including, shoulder means for engaging a shell formed on said flexible wall means and projecting into said column space.

3. The loader of claim 1 including, lip means for retaining said pusher means formed on said flexible wall means and projecting into said column space.

4. The loader of claim 1 including, finger means extending from one end of said flexible wall means to removably cover the end of said column space.

5. The loader of claim 1 wherein, said handle includes a web attached to said body.

6. The loader recited in claim 1 including, cap means adapted to cover at least one end of said flexible wall means.

7. The loader recited in claim 1 including, latch means extending outwardly from the outer surface of said flexible wall means.

8. The loader recited in claim 1 wherein, said slot means extends from end-to-end along the length of said flexible wall means.

9. The loader means recited in claim 1 wherein, each said detent means in annular form comprises a groove formed in the surface of said body.

10. The loader means recited in claim 1 wherein, said detent means are arranged in parallel with each other.

11. A shotgun speed loader comprising:

flexible wall means defining a column space for receiving at least one shell, and defining a storage position connected with said column space;

slot means is formed in said flexible wall means;

pusher means mounted in said flexible wall means and movable from one end of said flexible wall means through said slot means thereby effecting rapid discharge of the shell from said column space;

said pusher means includes a body and a handle joined thereto;

said handle moveable in said slot means, and said body movable in said column space, when said pusher means is moved from said storage position; and a removable strip extending across a portion of said slot means to temporarily restrain said pusher means.

* * * * *